US007434614B2

(12) United States Patent
Nelson et al.

(10) Patent No.: US 7,434,614 B2
(45) Date of Patent: Oct. 14, 2008

(54) SAFETY LOCK FOR ELEVATORS

(75) Inventors: Robert Nelson, Ventura, CA (US); Martin Jansen, Agoura Hills, CA (US)

(73) Assignee: Weatherford/Lamb, Inc., Houston, TX (US)

( * ) Notice: Subject to any disclaimer, the term of this patent is extended or adjusted under 35 U.S.C. 154(b) by 220 days.

(21) Appl. No.: 11/184,934

(22) Filed: Jul. 19, 2005

(65) Prior Publication Data

US 2006/0011352 A1 Jan. 19, 2006

Related U.S. Application Data

(60) Provisional application No. 60/589,194, filed on Jul. 19, 2004.

(51) Int. Cl.
*E21B 19/06* (2006.01)

(52) U.S. Cl. ..... 166/77.52; 166/379; 294/90; 294/102.2

(58) Field of Classification Search ..... 166/379, 166/77.52, 380; 294/90, 91, 102.2
See application file for complete search history.

(56) References Cited

U.S. PATENT DOCUMENTS 1,511,699 A 10/1924 Wilcox
1,599,144 A * 9/1926 Paulsen ..... 294/90
1,725,459 A * 8/1929 Krell et al. ..... 294/90
1,737,369 A * 11/1929 Gidley ..... 294/91
1,814,407 A 7/1931 Peebles
2,109,493 A * 3/1938 Lundeen ..... 188/67
2,722,450 A * 11/1955 Nelson ..... 294/90
3,140,523 A 7/1964 Taylor, Jr.
3,358,341 A * 12/1967 Burstall ..... 294/102.2
4,361,940 A 12/1982 McFadden
4,396,216 A * 8/1983 Hamilton ..... 294/90
5,340,182 A 8/1994 Busink et al.
5,755,289 A 5/1998 Angman et al.
6,073,699 A 6/2000 Hollingsworth, Jr.
6,494,273 B1 12/2002 Martin

OTHER PUBLICATIONS

U.K. Search Report, Application No. GB0514806.9, dated Aug. 11, 2005.

* cited by examiner

*Primary Examiner*—Jennifer H Gay
*Assistant Examiner*—Daniel P Stephenson
(74) *Attorney, Agent, or Firm*—Patterson & Sheridan, LLP

(57) ABSTRACT

An elevator having a safety lock is provided to prevent the inadvertent release of a tubular. In one embodiment, the elevator includes a body for supporting the tubular and a locking apparatus activatable by an upset portion of the tubular, the safety locking apparatus adapted to prevent the tubular handling apparatus from releasing the tubular when activated. In another embodiment, the elevator is provided with a secondary override locking device for the safety lock so that jarring operations may be performed using the elevator.

31 Claims, 15 Drawing Sheets

SAFETY LOCK FOR ELEVATORS

CROSS-REFERENCE TO RELATED APPLICATIONS

This application claims benefit of U.S. Provisional Patent Application Ser. No. 60/589,194, filed on Jul. 19, 2004, which application is herein incorporated by reference in its entirety.

BACKGROUND OF THE INVENTION

1. Field of the Invention

The present invention relates to methods and apparatus for handling wellbore tubulars. Particularly, the invention relates to an elevator for supporting tubulars for use in wellbore operations. More particularly still, the invention relates to a safety lock for an elevator.

2. Description of the Related Art

The process of running tubulars into a wellbore generally involves the use of an elevator in tandem with a spider. The elevator is typically used to raise or lower the wellbore tubular. As such, the elevator is suspended from a rig hook, which controls the movement of the elevator. A typical elevator comprises two body parts hinged together by a hinge shaft at one end and latched at another end using a latch mechanism. Lift ears may be provided to connect to the bails or other links attached to the rig hook. The elevator includes a bore for receiving the wellbore tubular. The bore is sized such that it is larger than the outer diameter of the tubular, but smaller than the upset area of the tubular. In this respect, the elevator supports the tubular at its upset area during movement.

The spider is typically used for securing the tubular string in the wellbore. A spider generally includes a plurality of slips circumferentially disposed on a "bowl". The bowl is regarded to be the surfaces on the inner bore of the spider. The exterior surface of the slips and the interior surface of the bowl have opposing engaging surfaces which are inclined and downwardly converging. The inclined surfaces allow the slip to move vertically and radially relative to the bowl. In effect, the inclined surfaces serve as a camming surfaces for engaging the slip with the tubular. Thus, when the weight of the tubular is transferred to the slips, the slips will move downwardly with respect to the bowl. As the slips move downward along the inclined surfaces, the inclined surfaces urge the slips to move radially inward to engage the tubular. In this respect, this feature of the spider is referred to as "self tightening." Further, the slips are designed to prohibit release of the tubular string until the load is supported by another means.

In the makeup or breakup of wellbore tubulars, the spider remains stationary on the rig floor while securing the tubular string in the wellbore. The elevator positions a tubular section above the tubular string for connection therewith. After completing the connection, the elevator pulls up on the tubular string to release the tubular string from the slips of the spider. The elevator may now lower the tubular string into the wellbore. Before the tubular string is released from the elevator, the spider is allowed to engage the tubular string again to support the tubular string. After the load of the tubular string is transferred back to the spider, the elevator releases the tubular string and continues the tubular makeup process by picking up another tubular section One of the problems encountered during wellbore operations such as tubing running is the inadvertent release of the tubular section from the elevator. For example, it has been known that the latch mechanism of the elevator may become unlatched due to improper closing or mechanical failure of the latch. Also, the latch mechanism may fail during jarring operations to free a stuck section of the wellbore tubular. The premature release of the tubular section presents a safety hazard to the rig personnel.

There is a need, therefore, for a locking mechanism which will prevent the inadvertent release of the tubular section. There is also a need for a secondary locking mechanism to prevent the inadvertent release of the tubular section if the latch lock fails.

SUMMARY OF THE INVENTION

In one embodiment, a tubular handling apparatus for supporting a tubular is provided. The apparatus includes a body for supporting the tubular and a locking apparatus activatable by an upset portion of the tubular. The locking apparatus is adapted to prevent the tubular handling apparatus from releasing the tubular when activated.

In another embodiment, a tubular handling apparatus for supporting a tubular includes a body for supporting the tubular and a safety locking apparatus activatable by a load of the tubular. The safety locking apparatus is adapted to prevent the tubular handling apparatus from releasing the tubular when activated. In one aspect, the load of the tubular is transferred to the elevator through an upset portion of the tubular.

In another embodiment, a method for supporting a tubular includes providing a tubular handling apparatus having a body for receiving the tubular and a locking apparatus activatable by the tubular. The method further includes inserting the tubular through the body and engaging an upset portion of the tubular with the locking apparatus, thereby activating the locking apparatus to prevent the body from releasing the tubular.

In another embodiment, an elevator for handling a tubular includes a first body member coupled to a second body member, an actuating member operatively coupled to the elevator for engaging the tubular, and a locking member adapted to engage the actuating member, wherein engagement with the actuating member secures the first body member and the second body member against opening.

BRIEF DESCRIPTION OF THE DRAWINGS

So that the manner in which the above recited features of the present invention, and other features contemplated and claimed herein, are attained and can be understood in detail, a more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

An elevator having a safety lock is provided to prevent the inadvertent release of a tubular. In one embodiment, the elevator includes a body for retaining the tubular and a locking device activatable by an upset portion of the tubular. The locking device is adapted to prevent the tubular handling apparatus from releasing the tubular when activated. In another embodiment, the elevator is provided with a secondary locking device for the safety lock so that jarring operations may be performed using the elevator.

Figure 1:
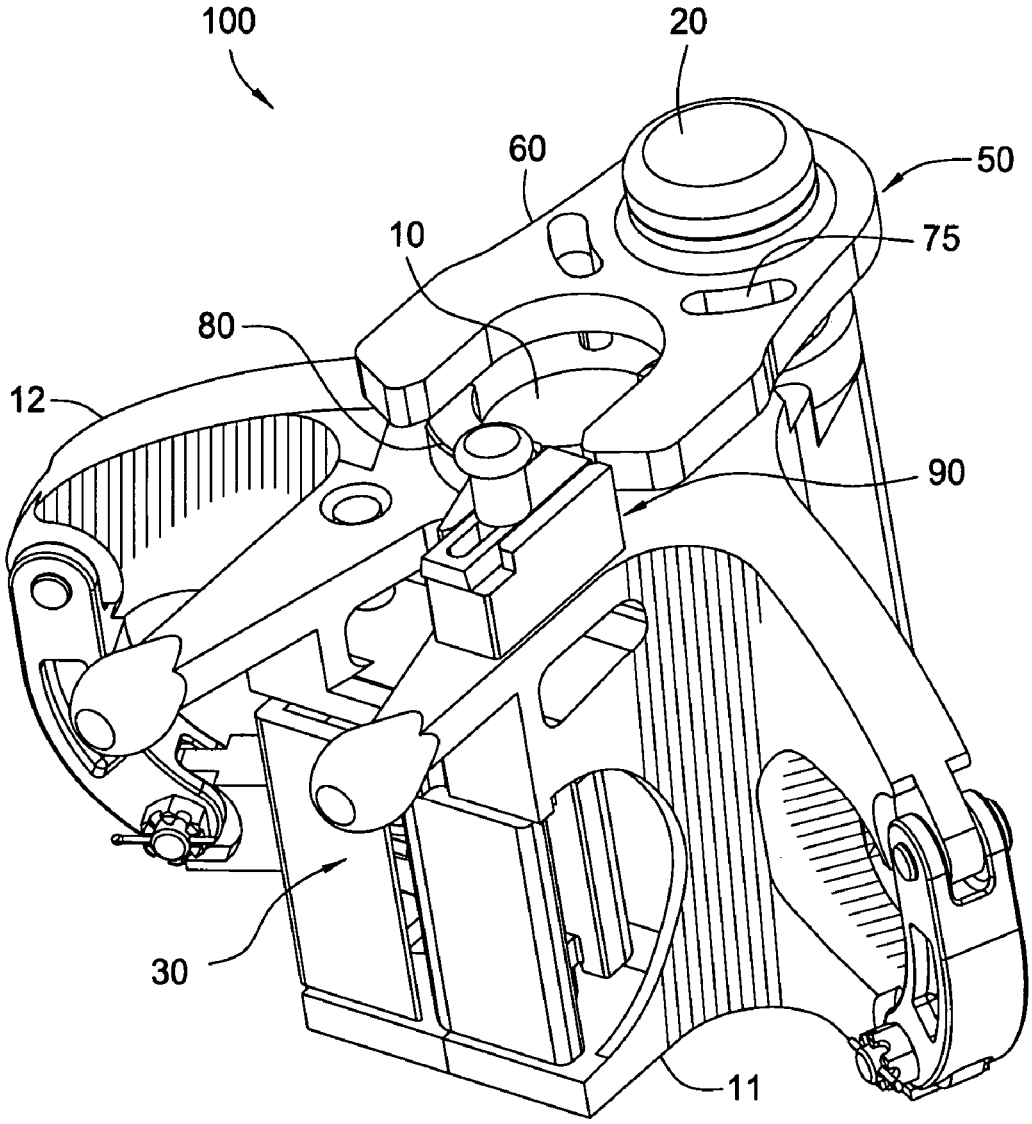
FIG. 1 shows an embodiment of an elevator having a safety lock assembly.

FIG. 1 shows an elevator 100 having a body with a bore 10 therethrough for receiving a tubular. The body comprises a pair of complementary body sections 11, 12 hinged together at one side by a hinge shaft 20. A portion of the bore 10 is formed on each body section 11, 12 such that the bore 10 is created when the body sections 11, 12 are brought together. The hinge connection allows the body sections 11, 12 to open and close in order to receive the tubular in the bore 10. The body sections 11, 12 are provided with a cooperative latch assembly 30 for holding the body sections 11, 12 against opening. The elevator 100 may include apertures and respective fittings 23 for supplying lubricants to the hinges of the body sections 11, 12.

Figure 2:
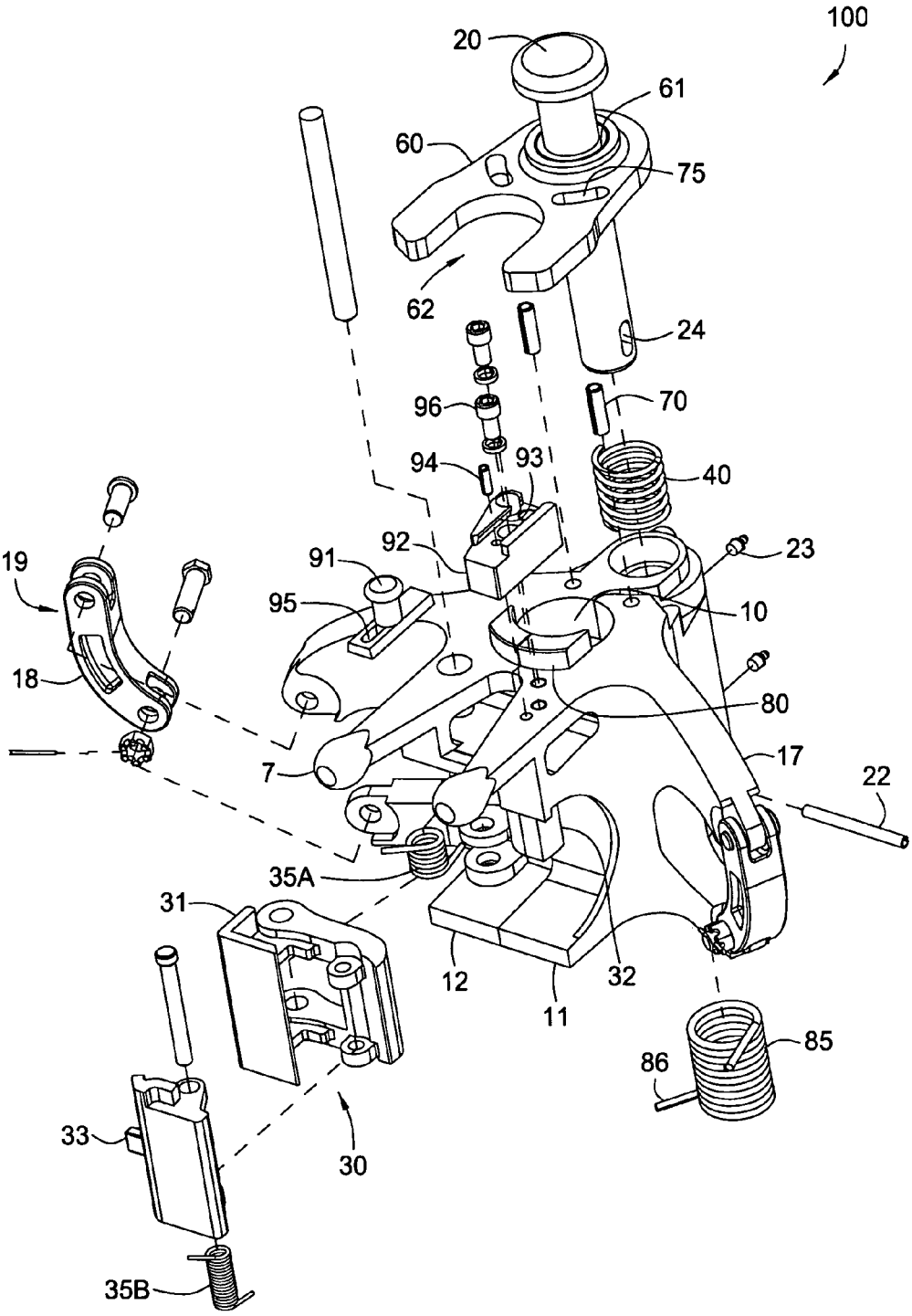
FIG. 2 is another view of the elevator of FIG. 1.

Referring now to FIG. 2, in one embodiment, the latch assembly 30 includes a latch 31 pivotably coupled to one of the body sections 12. The latch 31 is adapted to mate with a lug 32 formed on the other body section 11. A latch lock 33 is provided to secure the latch 31 to the lug 32. One or more biasing members 35A, 35B such as a spring may be used to facilitate the opening and closing of the latch 31 or the latch lock 33. In one aspect, the elevator has self locking capabilities due to the spring loaded latch 31 and latch lock 33. It must be noted that other suitable latch assemblies known to a person of ordinary skill in the art are equally applicable to the embodiments disclosed herein.

Each of the body sections 11, 12 is provided with a lift ear 17 for receiving links running from a hoisting structure such as rig hook or top drive. The lift ears 17 may include a gate 19 for coupling and decoupling from the links. As shown in FIG. 2, a suitable gate 19 comprises a link block 18 pivotally connected to a lift ear 17 at one end. The other end of the link block 18 may be bolted or selectively secured to the lift ear 17. In another embodiment, the gate 19 may be formed on the receiving links to allow connection to the lift ears 17. The body sections 11, 12 are also provided with handles 7 to facilitate opening and closing of the elevator 100.

As shown in FIG. 1, the elevator 100 is provided with a safety lock assembly 50 to prevent the elevator 100 from opening inadvertently when it is handling a tubular. The safety lock assembly 50 comprises an actuating member that is actuatable by contact with the tubular. In one embodiment, the actuating member comprises a locking plate 60 coupled to the hinge shaft 20 connecting the two body sections 11, 12. The locking plate 60 is disposed on top of the elevator 100 and is retained thereon by inserting the hinge shaft 20 through a hole 61 in the locking plate 60. The locking plate 60 includes an opening 62 that is aligned with the bore 10 of the elevator 100 in order to accommodate the tubular retained by the elevator 100. The opening 62 is sized sufficiently to accommodate the outer diameter of the tubular, but is smaller than the outer diameter of the coupling or upset portion of the tubular. Preferably, the opening 62 is horseshoe shaped, and the locking plate 60 is arranged on the elevator 100 such that access to the opening 62 is directed toward the tubular entrance of the elevator 100. Preferably, a width of the opening 62 is about the size of the diameter of the elevator bore 10.

Figure 3:
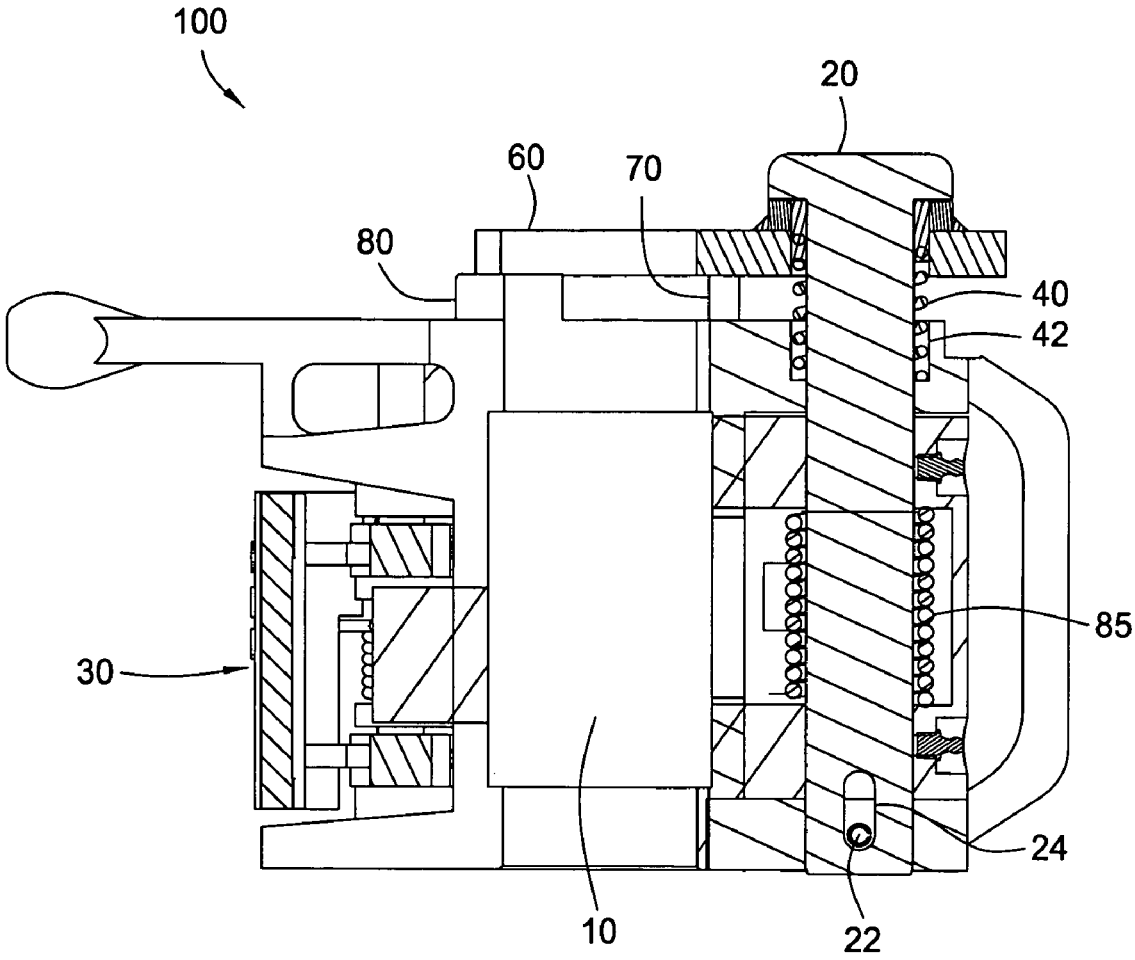
FIG. 3 is a cross-sectional view of the elevator of FIG. 1.
Figure 6:
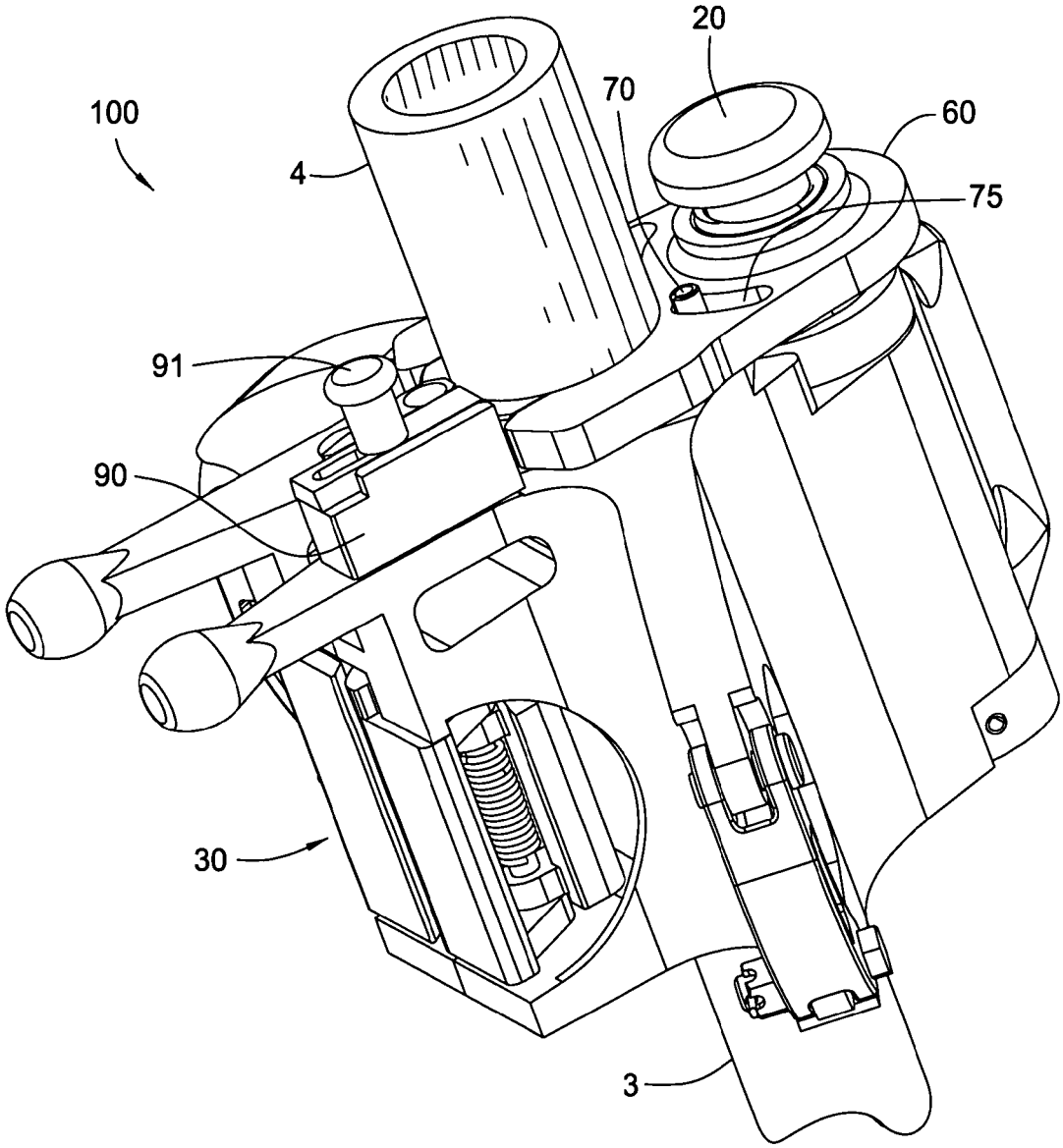
FIG. 6 is a perspective view of the elevator of FIG. 1 with the safety lock assembly activated.
Figure 7:
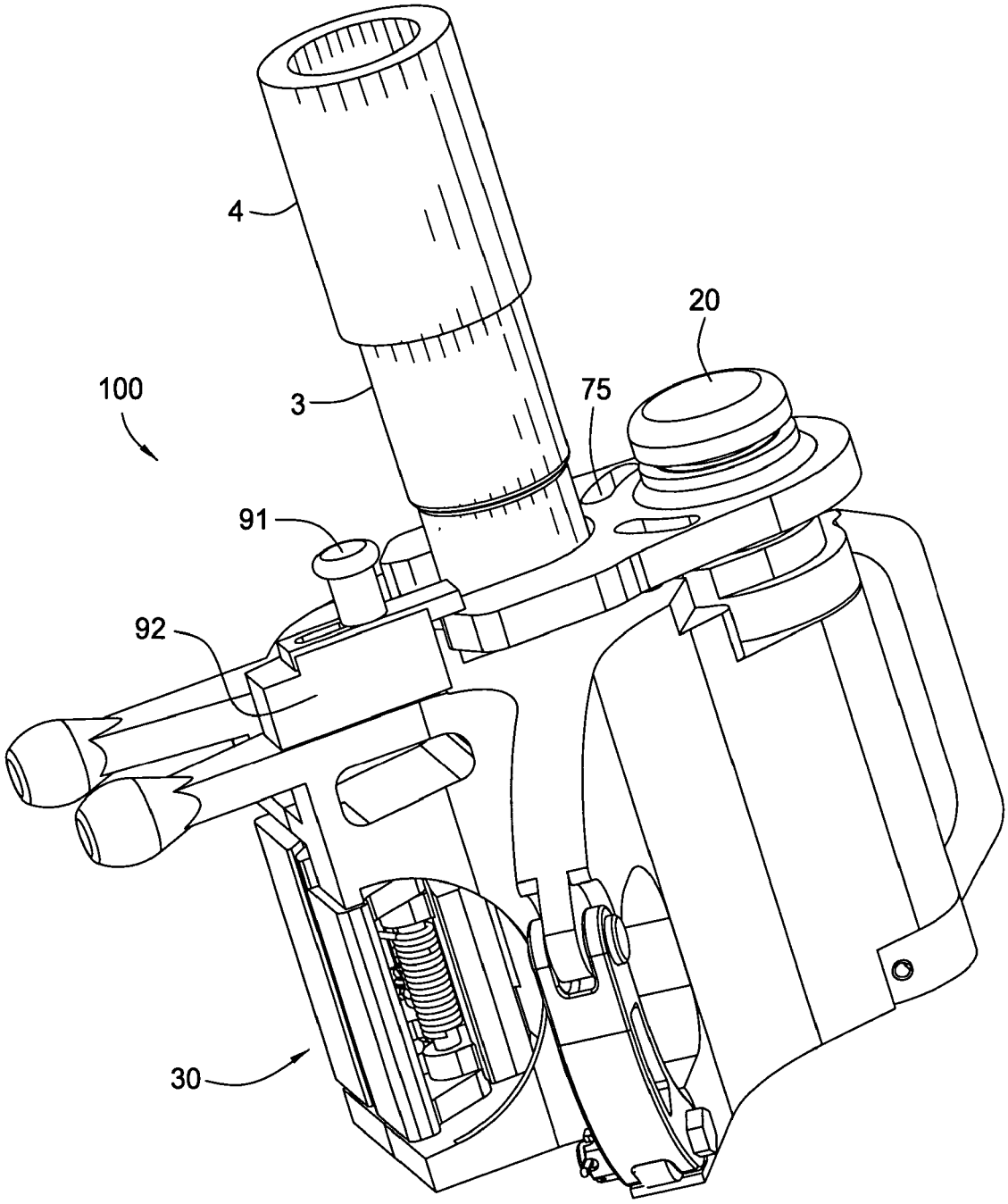
FIG. 7 is a perspective view of the elevator of FIG. 1 with the secondary locking device activated.

The locking plate 60 is movable between an activated position and an unactivated position during operation. In one embodiment, the locking plate 60 is biased in the unactivated position by a biasing member. As shown in FIGS. 2 and 3, the locking plate 60 is biased by a locking spring 40 disposed in the hinge portion of the body sections 11, 12. One end of the locking spring 40 seats in a recessed portion 42 of the body sections 11, 12, while the other end is in contact with a lower surface of the locking plate 60. The hinge shaft 20 is inserted through the hole 61 in the locking plate 60 and the spring 40. In the unactivated position, the spring 40 biases the locking plate 60 away from the upper surface of the elevator 100. In the activated position, the locking plate 60 is compressed against the upper surface of the elevator 100. During operation, upper surface of the locking plate 60 is caused to contact the coupling or the upset portion of the tubular. When the locking plate 60 engages the tubular, the weight of the tubular overcomes the locking spring 40, thereby moving the locking plate 60 into the activated position. FIG. 6 shows the locking plate 60 in the activated position.

The hinge shaft 20 is adapted to facilitate movement of the locking plate 60 between the activated and unactivated positions. Preferably, the top of the hinge shaft 20 has an outer diameter that is larger than the hole 61 in the locking plate 60. A connection member such as a roll pin 22 is inserted through a lower portion of the hinges and the hinge shaft 20 to retain the hinge shaft 20 in the hinges. In one embodiment, an axial slot 24 is formed on a lower portion of the hinge shaft 20, as illustrated in FIG. 3. In this respect, the hinge shaft 20 may move relative to the roll pin 22. When the locking plate 60 moves between the two positions, the hinge shaft 20 is allowed to move with the locking plate 60. In another embodiment, the hinge shaft 20 is of sufficient length such that it may remain stationary while the locking plate 60 moves relative to the hinge shaft 20.

Figure 4:
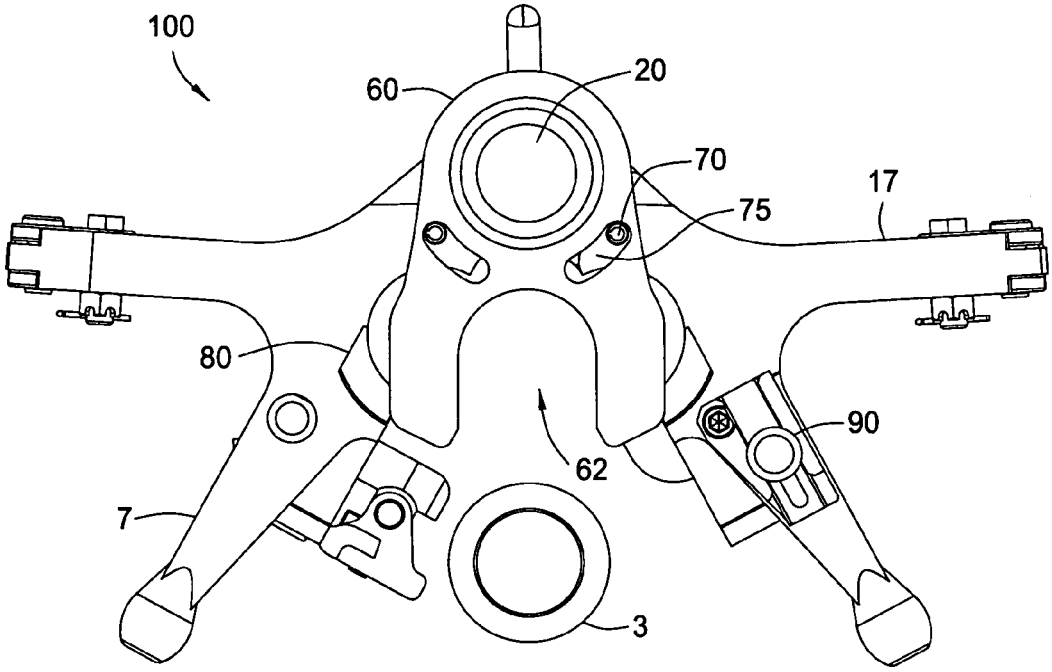
FIG. 4 is a top view of the elevator of FIG. 1 in the open position.
Figure 5:
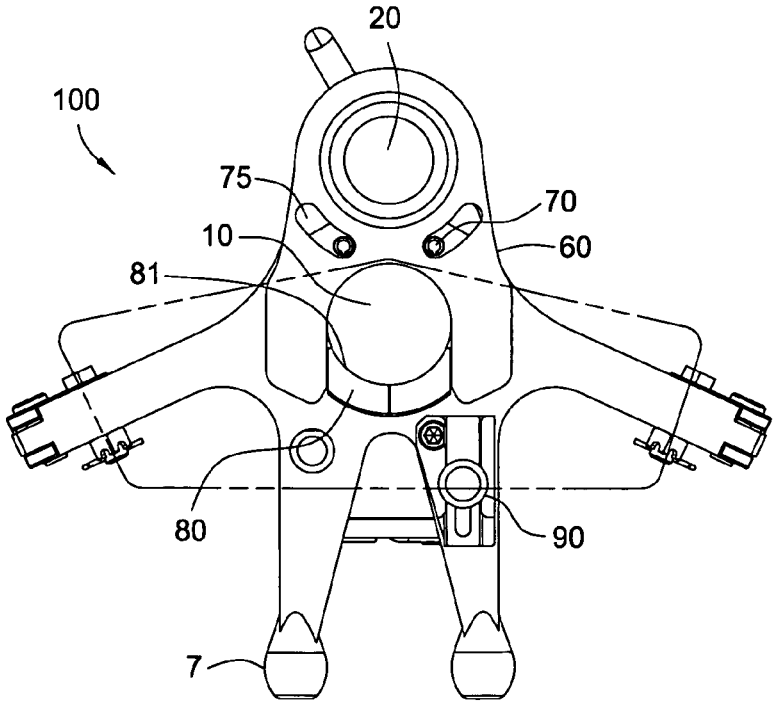
FIG. 5 is a top view of the elevator of FIG. 1 in the closed position.

To ensure that the opening of the locking plate 60 is aligned with the bore of the elevator 100, one or more guiding mechanisms are provided on the elevator 100. In the embodiment shown in FIGS. 1, 4, and 5, the guiding mechanism comprises a guide member 70 disposed on a body section 11, 12 adapted to mate with a guide slot 75 formed in the locking plate 60. Preferably, a guide member 70 such as a guiding rod is provided for each body section 11, 12. The guide slot 75 is adapted such that the guide member 70 is movable therein as the body sections 11, 12 are opened and closed. For example, the guide slot 75 may be arcuate in shape to accommodate for pivotal movement between the body sections 11, 12. FIG. 4 shows the elevator 100 in the open position, and FIG. 5 shows the elevator 100 in the closed position. It can be seen that movement of the locking plate 60 is limited by the guide members 70 in the guide slots 75. In this manner, the opening 62 of the locking plate 60 may be positioned in substantial alignment with the bore 10 of the elevator 100. Preferably, the guide members 70 have sufficient length such that at least a portion of the guide members 70 is disposed in the guide slot 75 when the locking plate 60 is in the unactivated position, as shown in FIG. 3. In FIG. 6, it can seen that a portion of the guide members 70 protrude out of the guide slot 75 due to the movement of the locking plate 60 to the activated position.

When the locking plate 60 is in the activated position, the elevator 100 is prevented from opening by one or more locking members 80 formed on the elevator 100. As shown in FIG. 1, one locking member 80 is formed or disposed on the upper surface of each body section 11, 12. A suitable locking member 80 comprises a boss formed on body sections 11, 12. The height of the locking members 80 is such that the top of the locking members 80 is below the locking plate 60 when the locking plate 60 is in the unactivated position. In this respect, the elevator 100 is allowed to swing open or close. This is more clearly seen in FIGS. 3 and 4. Additionally, the locking members 80 are adapted and sized to fit in the opening 62 of the locking plate 60, as illustrated in FIGS. 5 and 6. In this respect, the locking members 80 do not obstruct the movement of the locking plate 60 to the activated position. FIG. 5 shows the elevator 100 closed, but the locking plate 60 is still in the unactivated position. FIG. 6 shows the locking plate 60 in the activated position. As shown, the locking members 80 are disposed within the opening 62 of the locking plate 60. In the activated position, movement of the locking members 80 is limited by the locking plate 60. In turn, the body sections 11, 12 of the elevator 100 are prevented from opening. In the preferred embodiment, the locking members 80 have an arcuate side 81 that is complementary to the bore 10 of the elevator 100, as shown in FIG. 5. Additionally, the height of the locking members 80 is about the same as the thickness of the locking plate 60. In this respect, when the tubular is lowered on top of the locking plate 60, the tubular may be supported circumferentially by the locking members 80 and the locking plate 60.

Referring back to FIGS. 1 and 2, the elevator 100 may optionally be equipped with a secondary locking device 90 to secure the locking plate 60 in the activated position. In one embodiment, the locking device 90 comprises a sliding latch 91 disposed on a latch block 92. The latch block 92 may be disposed on a body section 11 adjacent the locking plate 60. Preferably, the latch block 92 raises the sliding latch 91 sufficiently so that at least a portion of the latch 91 may be positioned over the locking plate 60 when the locking plate 60 is in the activated position. In this manner, the locking plate 60 is prevented from being biased back into the unactivated position even if the load of the tubular is removed from the locking plate 60. In one embodiment, the sliding latch 91 slides in a dovetail groove 93 formed on the latch block 92, as shown in FIG. 2. The dovetail groove 93 retains the sliding latch 91 on the latch block 92 during operation. The movement of the sliding latch 91 may be controlled by a pin 94 disposed in the latch block 92 and inserted through a slot 95 in the sliding latch 91. The latch block 92 may be attached to the elevator 100 in any manner known to a person of ordinary skill in the art. Suitable examples include a bolt or a cap screw 96. In the embodiment show, the sliding latch 91 is positioned above the cap screw 96 to prevent the cap screw 96 from decoupling. In another embodiment, a biased detent may be disposed between the sliding latch 91 and the latch block 92. The detent positions and holds the sliding latch 91 in the last position relative to the latch block 92 until sliding latch 91 is ready to be moved.

The elevator 100 may also optionally include an elevator 100 biasing member to facilitate the opening and closing of the elevator 100. As shown in FIGS. 1 and 3, a tension spring 85 is inserted through the hinge shaft 20 and disposed adjacent to the body sections 11, 12. The tension spring 85 includes one or more extension members 86 adapted to bias the body sections 11, 12 in the open position. In this respect, the tension spring 85 facilitates the opening of the elevator 100. Additionally, when the elevator 100 is closed, the tension force generated by the tension spring 85 helps to keep the latch 31 engaged to the lug 32.

During operation, the safety lock assembly is advantageously used to prevent the inadvertent opening of the elevator 100. FIGS. 3-7 show the elevator in operation. FIG. 4 is a top view of the elevator 100 showing the elevator 100 in the open position and ready to receive a tubular 3. As such, the guide members 70 are at their widest positions in the guide slots 75. Also, the locking plate 60 is in the unactivated position as it is biased away from the upper surface of the elevator 100 by the locking spring 40. The tubular 3 is positioned such that the locking plate 60 and the elevator 100 engage a portion of the tubular located below the coupling or upset portion 4.

FIG. 5 is a view of the elevator in the closed position without the tubular 3. As shown, the guide members are at their closest positions in the guide slots 75. Also, the locking members 80 have been brought together and are located within the opening 62 of the locking plate 60. Once the elevator 100 is closed, the latch assembly 30 is actuated to lock the elevator 100.

At this point, the hoisting structure is actuated to lift the elevator 100 and the tubular 3. Initially, the elevator 100 will slide along the tubular 3 until the locking plate 60 comes into contact with the upset portion 4 of the tubular 3. As the elevator 100 continues to be lifted, the locking plate 60 is compressed against the upper surface of the elevator 100. As a result, the locking plate 60 is moved to the activated position, as illustrated in FIG. 6. In this position, the upset portion 4 of the tubular 3 rests on the locking plate 60 and the locking members 80. Thereafter, continued lifting of the elevator 100 will also lift the tubular 3. In this respect, the load of the tubular 3 is maintained on the locking plate 60, thereby keeping the locking plate 60 in the activated position. In this manner, the elevator 100 is provided with a safety lock assembly 50 to prevent the inadvertent release of the tubular 3.

In some instances, a jarring operation is necessary to free a tubular in the wellbore. The secondary locking device 90 may be activated before starting the jarring operation. To activate the locking device 90, the sliding latch 91 is shifted toward the locking plate 60. The detent in the latch block 92 keeps the sliding latch 91 in the desired position. In this manner, the sliding latch 91 prevents the locking plate 60 from deactivating even if the jarring operation inadvertently causes the upset portion 4 of the tubular 3 to unseat from the locking plate 60.

Figure 8:
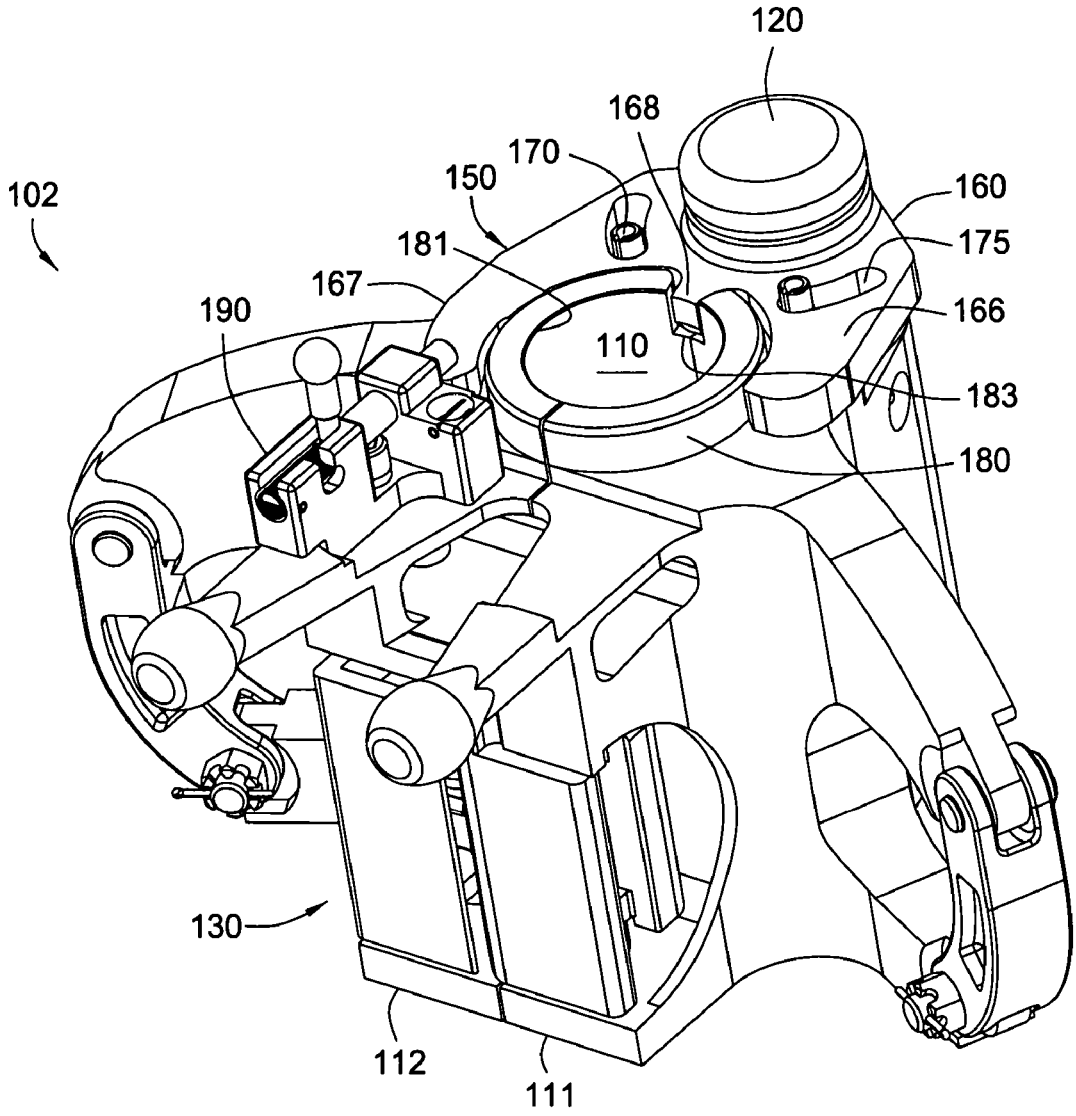
FIG. 8 shows another embodiment of an elevator having a safety lock assembly.
Figure 9:
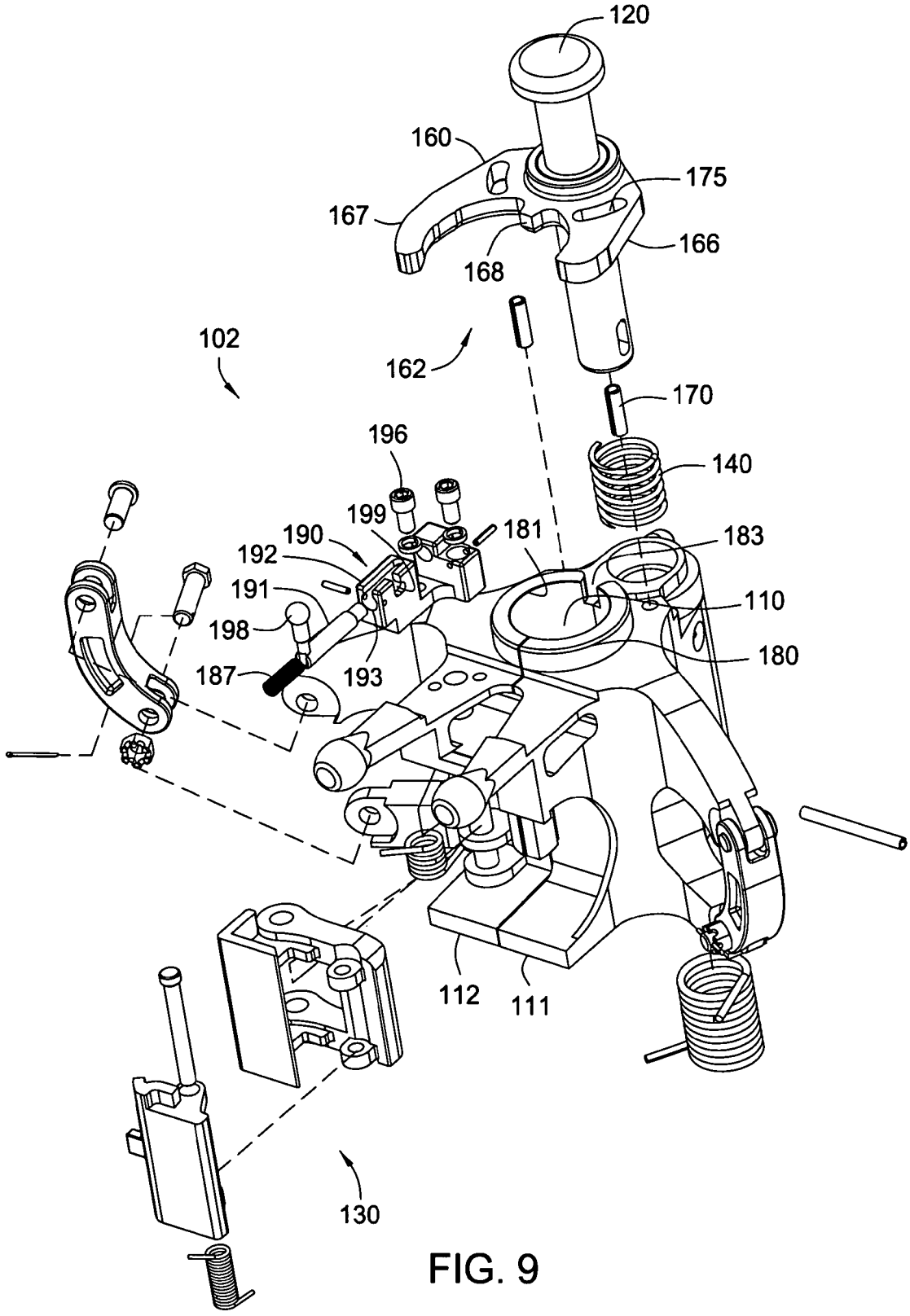
FIG. 9 is another view of the elevator of FIG. 8.

FIGS. 8 and 9 show another embodiment of a safety lock assembly 150 for an elevator 102. The elevator 102 is substantially similar to the elevator 100 shown in FIG. 1; as such, like parts will not be described again herein. The elevator 102 includes a first body section 111 and a second body section 112 operatively coupled together using a hinge shaft 120. A latch assembly 130 is provided to hold the body sections 111, 112 against opening.

In this embodiment, the safety lock assembly 150 comprises an actuating member that is actuatable by contact with the tubular. In one embodiment, the actuating member comprises a locking plate 160 coupled to the hinge shaft 120 connecting the two body sections 111, 112. The locking plate 160 is disposed on top of the elevator 102 and includes an opening 162 that is aligned with the bore 110 of the elevator 102 in order to accommodate the tubular retained by the elevator 102. As shown, the locking plate 160 is arranged on the elevator 102 such that access to the opening 162 is directed toward the tubular entrance of the elevator 102. In one embodiment, the opening 162 includes two extension members 166, 167 arranged to form the U-shaped opening, which is sufficiently sized to accommodate the locking members 180 on the elevator 102. The locking plate 160 includes an engagement member 168 that protrudes into the opening 162 sufficiently to engage an upset portion of the tubular, but not obstruct the bore 110.

The locking plate 160 is biased in the unactivated position by a locking spring 140 disposed in the hinge portion of the body sections 111, 112. In the unactivated position, the spring 140 biases the locking plate 160 away from the upper surface of the elevator 102 at a height above the locking members 180. In the activated position, the locking plate 160 is compressed against the upper surface of the elevator 102 and the extension members 166, 167 at least partially encircle the locking members 180. During operation, the tubular will contact the engagement member 168 of the locking plate 160 and the weight of the tubular will cause the locking plate 160 to move to the activated position. FIG. 8 shows the locking plate 160 in the activated position.

One or more guiding members 170 are provided on the elevator 102 to ensure that the opening 162 of the locking plate 160 is aligned with the bore 110 of the elevator 102. The guide members 170 are adapted to mate with a guide slot 175 formed in the locking plate 160. Preferably, the guide slot 175 is adapted such that the guide member 170, in this case, a guiding rod, is movable therein as the body sections 111, 112 are opened and closed. In this manner, the opening 162 of the locking plate 160 may be positioned in substantial alignment with the bore 110 of the elevator 102.

When the locking plate 160 is in the activated position, the elevator 102 is prevented from opening by one or more locking members 180 formed on the elevator 102. As shown in FIG. 8, one locking member 180 is formed or disposed on the upper surface of each body section 111, 112. A suitable locking member 180 comprises a boss formed on the body sections 111, 112. Preferably, the locking members 180 combine to substantially form a cylinder on the body sections 111, 112. A recess 183 is provided between the locking members 180 for receiving the engagement member 168 of the locking plate 160. The locking members 180 are adapted and sized to fit in the opening 162 of the locking plate 160, as illustrated in FIG. 8. In the activated position, movement of the locking members 180 is limited by the locking plate 160, thereby preventing the elevator 102 from opening. In the preferred embodiment, the locking members 180 have an arcuate side 181 that is complementary to the bore 110 of the elevator 102. The height of the locking members 180 is such that the top of the locking members 180 is below the locking plate 160 when the locking plate 160 is in the unactivated position. In this respect, the elevator 102 is allowed to swing open or close. Additionally, the locking members 180 are adapted to engage the upset portion of the tubular and support the weight of the tubular. The height of the locking members 180 should be greater than or equal to the thickness of the locking plate 160. In this respect, when the tubular urges the locking plate 160 into the activated position, the tubular is substantially supported circumferentially by the locking members 180. In turn, the load of the tubular is transferred from the locking members 180 to the elevator 102. Preferably, the locking members 180 are adapted to support at least 65% of the load; more preferably, at least 75% of the load; and most preferably, at least 85% of the load from the tubular.

In operation, the safety lock assembly is advantageously used to prevent the inadvertent opening of the elevator 102. Initially, the elevator 102 is in the open position and ready to receive a tubular. As such, the guide members 170 are at their widest positions in the guide slots 175. Also, the locking plate 160 is in the unactivated position as it is biased away from the upper surface of the elevator 102 by the locking spring 140. The tubular is positioned such that the locking plate 160 and the elevator 102 engage a portion of the tubular located below the coupling or upset portion.

FIG. 8 is a view of the elevator 102 in the closed position without the tubular. As shown, the guide members 170 are at their closest positions in the guide slots 175. Also, the locking members 180 have been brought together and are located within the opening 162 of the locking plate 160. Once the elevator 102 is closed, the latch assembly 130 is actuated to lock the elevator 102.

At this point, the hoisting structure is actuated to lift the elevator 102 and the tubular. Initially, the elevator 102 will slide along the tubular until the engagement member 168 of the locking plate 160 comes into contact with the upset portion of the tubular. As the elevator 102 continues to be lifted, the locking plate 160 is urged into contact with the upper surface of the elevator 102 and the engagement member 168 resides in the recess 183. The locking plate 160 is now in the activated position, as illustrated in FIG. 8. In this position, a substantial portion of the upset portion rests on the locking members 180, while only small portion is in contact with the engagement member 168. Additionally, the extension members 166, 167 are positioned around the periphery of the locking members 180. As long as the upset portion maintains contact with the engagement member 168, the locking plate 160 will remain in the activated position. In turn, the locking members 180 will remain within the opening 162 of the locking plate 160, thereby preventing the inadvertent release of the tubular.

As shown in FIGS. 8 and 9, the elevator 102 may optionally include a secondary locking device 190 to secure the locking plate 160 in the activated position. In one embodiment, the locking device 190 comprises a sliding latch pin 191 disposed on a latch block 192. The latch block 192 may be disposed on a body section 112 adjacent the locking plate 160. Preferably, the latch block 192 raises the latch pin 191 sufficiently so that at least a portion of the latch pin 191 may be positioned over the locking plate 160 when the locking plate 160 is in the activated position. In this manner, the locking plate 160 is prevented from being biased back into the unactivated position even if the load of the tubular is removed from the engagement member 168 of the locking plate 160. In one embodiment, the latch pin 191 slides in bore 193 formed in the latch block 192. The bore 193 retains the latch pin 191 on the latch block 192 during operation. Movement of the latch pin 191 may be controlled by a threaded pin 197 disposed in the bore 193 behind the latch pin 191. The latch block 192 may be attached to the elevator 102 in any manner known to a person of ordinary skill in the art. Suitable examples include a bolt or a cap screw 196. In the embodiment shown, the latch pin 191 is positioned above the cap screw 196 to prevent the cap screw 196 from decoupling. In another embodiment, the latch pin 191 may include a locking handle 198 adapted to fit in a handle slot 199 formed in a wall of the bore 193. When the latch pin 191 is retracted, the locking handle 198 may be rotated into contact with the handle slot 199, thereby maintaining the latch pin 191 in the retracted position until it is ready to be activated.

The secondary locking device 190 may be used to facilitate a jarring operation. Initially, the locking handle 198 is rotated out of the handle slot 199 to free the latch pin 191 for axial movement in the bore 193. Thereafter, the latch pin 191 is shifted toward the locking plate 160. As the same time, the threaded pin 197 is also advanced in the bore 193, thereby maintaining the latch pin 191 in the desired position. The latch pin 191 is advanced toward the locking plate 160 until a portion of the latch pin 191 is located above the extension member 167 of the locking plate 160. In this manner, the latch pin 191 prevents the locking plate 160 from deactivating even if the jarring operation inadvertently causes the upset portion of the tubular to unseat from the engagement member 168 of the locking plate 160.

Figure 10:
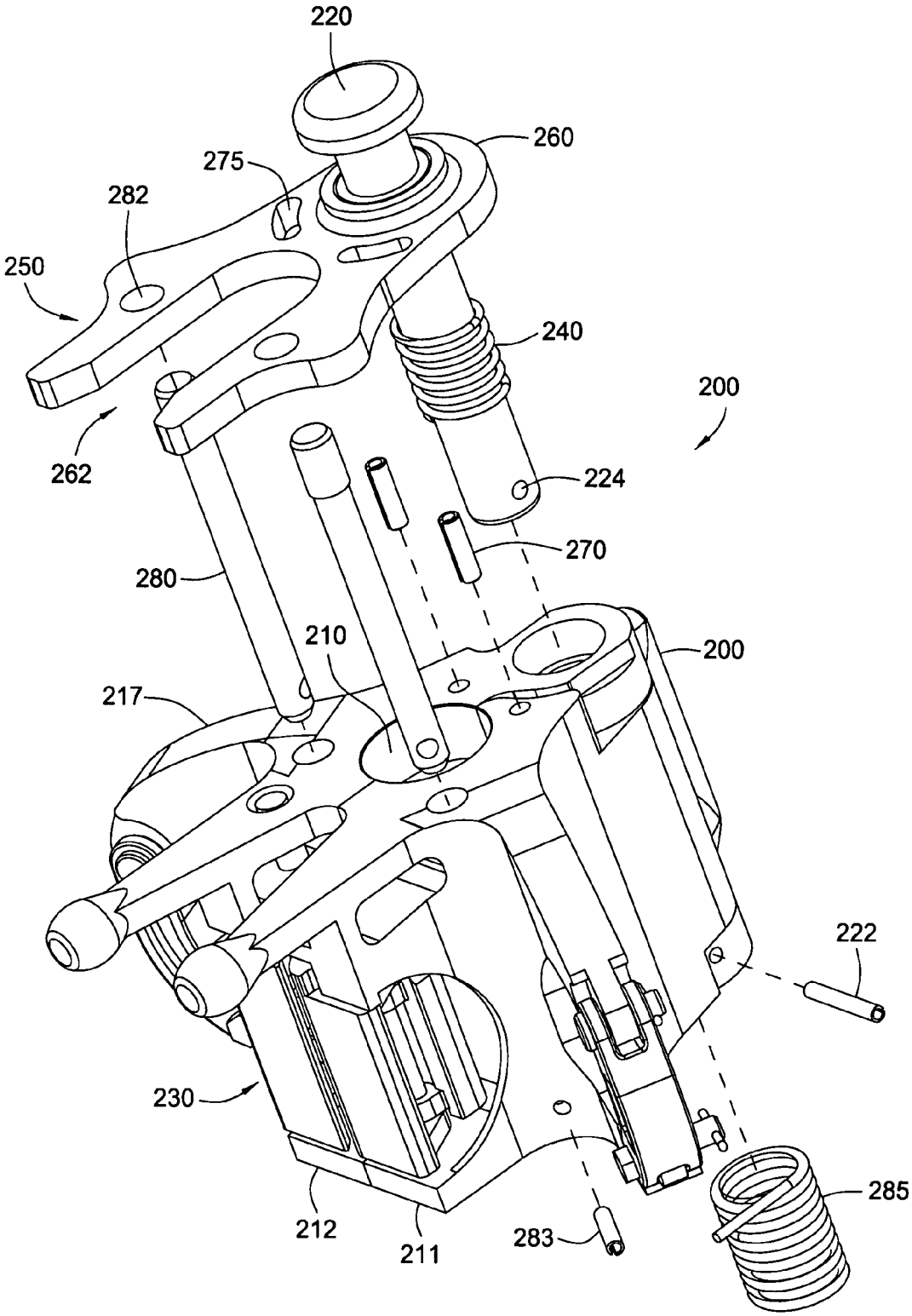
FIG. 10 shows another embodiment of an elevator having a safety lock assembly.

FIG. 10 shows another embodiment of a safety lock assembly 250. The elevator 200 is substantially similar to the elevator 100 shown in FIG. 1; as such, like parts will not be described again herein. The elevator 200 includes a first body section 211 and a second body section 212 operatively coupled together using a hinge shaft 220. A latch assembly 230 is provided to hold the body sections 211, 212 against opening.

In this embodiment, the safety lock assembly 250 comprises a locking plate 260 coupled to the hinge shaft 220 connecting the two body sections 211, 212. The locking plate 260 is disposed on top of the elevator 200 and includes an opening 262 that is aligned with the bore 210 of the elevator 200 in order to accommodate the tubular retained by the elevator 200. The opening 262 is sufficiently sized to accommodate the outer diameter of the tubular, but is smaller than the outer diameter of the coupling or upset portion of the tubular. As shown, the opening 262 is horseshoe shaped, and the locking plate 260 is arranged on the elevator 200 such that access to the opening 262 is directed toward the tubular entrance of the elevator 200. Preferably, a width of the opening 262 is about the size of the diameter of the elevator bore 210.

Figure 12:
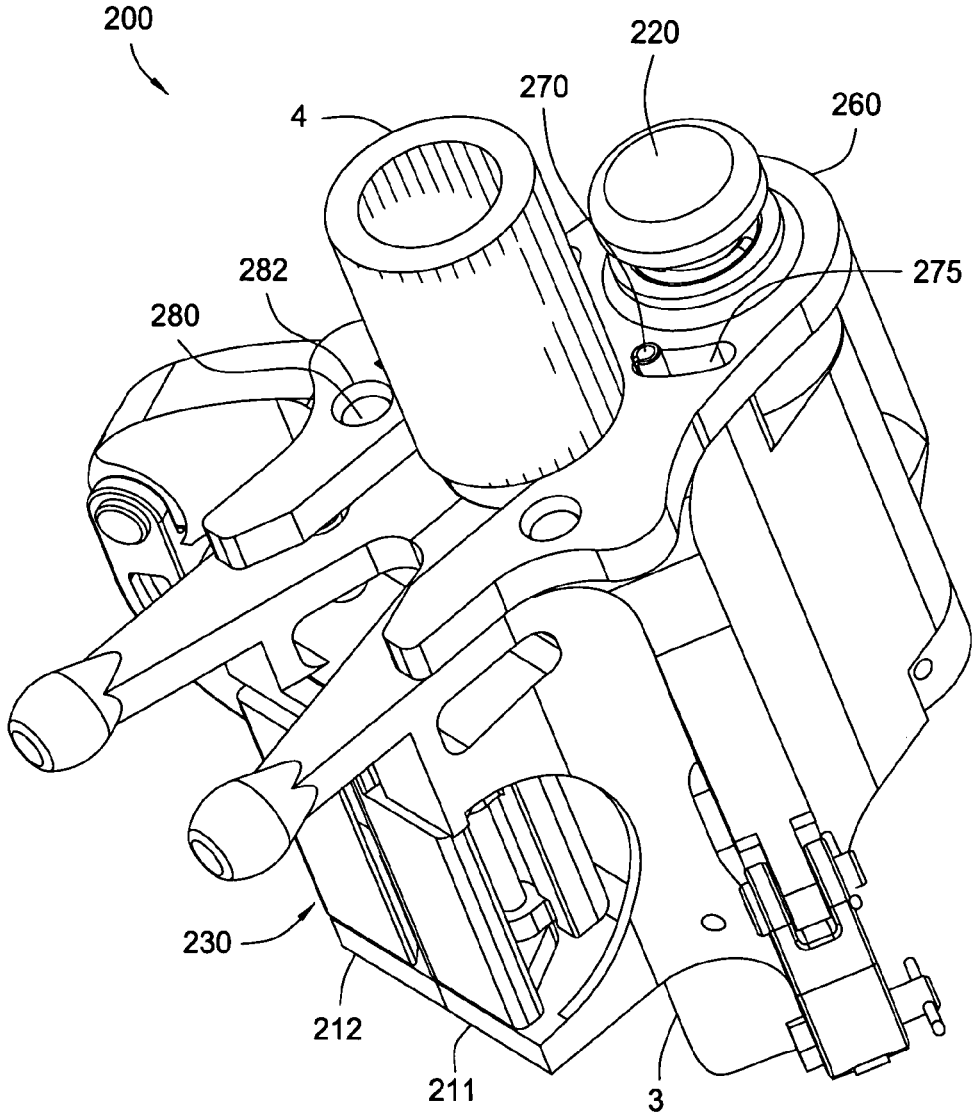
FIG. 12 is a perspective view of the elevator of FIG. 10 in the closed position.

The locking plate 260 is biased in the unactivated position by a locking spring 240 disposed in the hinge portion of the body sections 211, 212. One end of the locking spring 240 seats in a recessed portion 242 of the body sections 211, 212, while the other end is in contact with a lower surface of the locking plate 260. In the unactivated position, the spring 240 biases the locking plate 260 away from the upper surface of the elevator 200. In the activated position, the locking plate 260 is compressed against the upper surface of the elevator 200. During operation, the tubular will contact the upper surface of the locking plate 260 and the weight of the tubular will cause the locking plate 260 to move to the activated position. FIG. 12 shows the locking plate 260 in the activated position.

Figure 11:
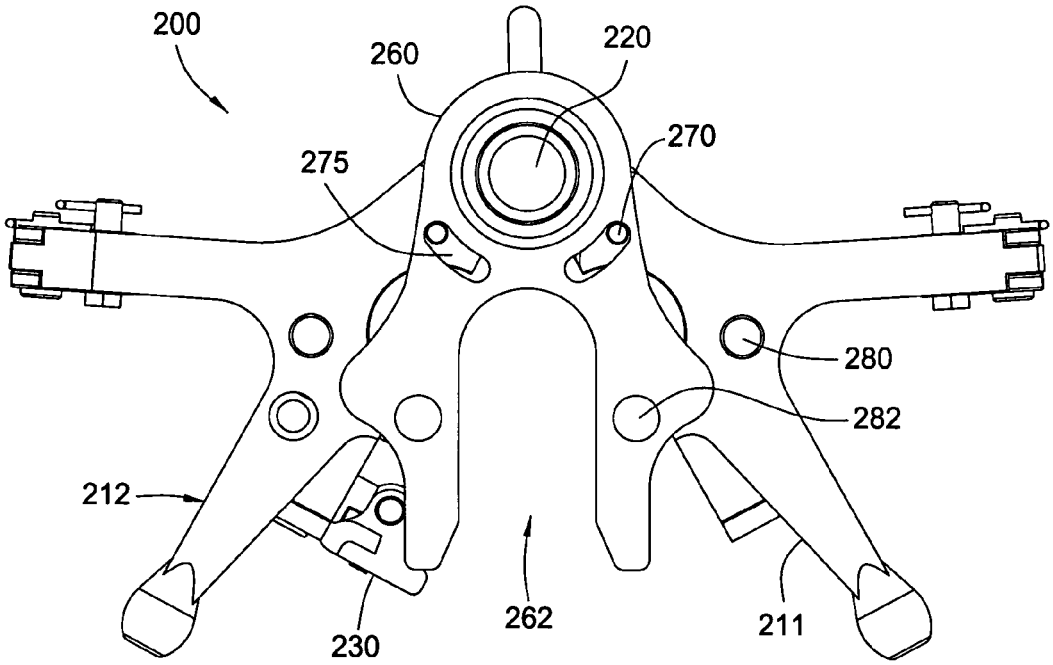
FIG. 11 is a top view of the elevator of FIG. 10 in the open position.

One or more guiding mechanisms are provided on the elevator 200 to ensure that the opening of the locking plate 260 is aligned with the bore 210 of the elevator 200. In the embodiment shown in FIG. 10, the guiding mechanism comprises a guide member 270 disposed on a body section 211, 212 adapted to mate with a guide slot 275 formed in the locking plate 260. Preferably, the guide slot 275 is adapted such that the guide member 270, in this case, a guiding rod, is movable therein as the body sections 211, 212 are opened and closed. FIG. 11 shows the elevator 200 in the open position, and FIG. 12 shows the elevator 200 in the closed position. It can be seen that movement of the locking plate 260 is limited by the guide members 270 in the guide slots 275. In this manner, the opening 262 of the locking plate 260 may be positioned in substantial alignment with the bore 210 of the elevator 200.

The hinge shaft 220 may be retained in the elevator 200 by inserting a connection member 222 such as a roll pin through a lower portion of the hinges and a pin channel 224 in the hinge shaft 220. Preferably, the hinge shaft 220 is of sufficient length such that the locking plate 260 is allowed to move relative to the hinge shaft 220 while the hinge shaft 220 remains substantially stationary axially. The elevator 200 may also optionally include an elevator biasing member to facilitate the opening and closing of the elevator 200. As shown in FIG. 10, a tension spring 285 is inserted through the hinge shaft 220 and disposed adjacent to the body sections 211, 212.

When the locking plate 260 is in the activated position, the elevator 200 is prevented from opening by one or more locking members 280 formed on the elevator 200. As shown in FIG. 10, the one locking member 280 is formed or disposed on the upper surface of each body section 211, 212. A suitable locking member 280 comprises locking pin disposed in the body section 211, 212 and having a portion extending above the upper surface of the body section 211, 212. The height of the extended portion of the locking members 280 is such that the top of the locking members 280 is below the locking plate 260 when the locking plate 260 is in the unactivated position. In this respect, the elevator 200 is allowed to swing open or close. This is more clearly seen in FIG. 11, which shows the elevator 200 in the open position. The locking members 280 are adapted to be received in an aperture 282 formed in the locking plate 260 when the elevator 200 is closed. In this respect, the locking members 280 do not obstruct the movement of the locking plate 260 to the activated position. FIG. 12 shows the locking plate 260 in the activated position. As shown, the locking members 280 are received within the aperture 282 of the locking plate 260. As a result, movement of the locking members 280 is limited by the locking plate 260. In turn, the body sections 211, 212 of the elevator 200 are prevented from opening. In the embodiment shown, each locking pin 280 is inserted in to its respective body section 211, 212 of the elevator 200 and is retained therein by a securing pin 283. It must be noted that other suitable methods for coupling the locking pin 222 to the elevator 200, such as welding or threaded connection, known to a person of ordinary skill in the art are contemplated.

In operation, the safety lock assembly 250 is advantageously used to prevent the inadvertent opening of the elevator 200. FIG. 11 is a top view of the elevator 200 in the open position and ready to receive a tubular 3. As such, the guide members 270 are at their widest positions in the guide slots 275. Also, the locking plate 260 is in the unactivated position as it is biased away from the upper surface of the elevator 200 by the locking spring 240. It can also be seen that the locking members 280 are positioned away from the apertures 282 in the locking plate 260. The tubular 3 is positioned such that the locking plate 260 and the elevator 200 engage a portion of the tubular 3 located below the coupling or upset portion 4.

Once the tubular 3 is properly positioned, the elevator 200 is closed and the latch assembly 230 is actuated. In this position, the locking members 280 are aligned with the apertures 282 of the locking plate 260.

At this point, the hoisting structure is actuated to lift the elevator 200 and the tubular 3. Initially, the elevator 200 will slide along the tubular 3 until the locking plate 260 comes into contact with the upset portion 4 of the tubular 3. As the elevator 200 continues to be lifted, the locking plate 260 is compressed against the upper surface of the elevator 200. As a result, the locking plate 260 is moved to the activated position, as illustrated in FIG. 12. In this position, the upset portion 4 of the tubular 3 rests on the locking plate 260 and the locking members 280. Also, the locking members 280 are now received in the apertures 282, thereby locking the elevator 200 in the closed position. Thereafter, continued lifting of the elevator 200 will also lift the tubular 3. In this respect, the load of the tubular 3 is maintained on the locking plate 260, thereby keeping the locking plate 260 in the activated position. In this manner, the elevator 200 is provided with a safety lock assembly 250 to prevent the inadvertent release of the tubular 3.

FIGS. 13-16 show another embodiment of a safety lock assembly 350. The elevator 300 includes a first body section 311 and a second body section 312 operatively coupled together using a hinge shaft 320. A latch assembly 330 is provided to hold the body sections 311, 312 against opening. The upper portion of the elevator 300 includes a collar 305 for receiving the coupling 4 or upset portion of a tubular 3.

As shown, the elevator 300 is in the closed position. In one embodiment, the safety lock assembly 350 comprises a housing 355 disposed above the hinge shaft 320. The housing 355 is positioned adjacent to the collar 305 such that the portion of the housing 355 above the collar 305 does not obstruct the axial movement of the coupling 4 toward the collar 305. The housing 355 is coupled to the second body section 312 of the elevator 300 and is rotatable therewith. The hinge shaft 320 is coupled to the first body section 311 and is rotatable therewith. The housing 355 and the hinge shaft 320 may be coupled to their respective body sections 311, 312 in any suitable manner known to a person of ordinary skill in the art. As shown, a securing pin or bolt 321 is used to couple the hinge shaft 320 to the first body section 311, while the housing 355 is bolted to the second body section 312.

Figure 13:
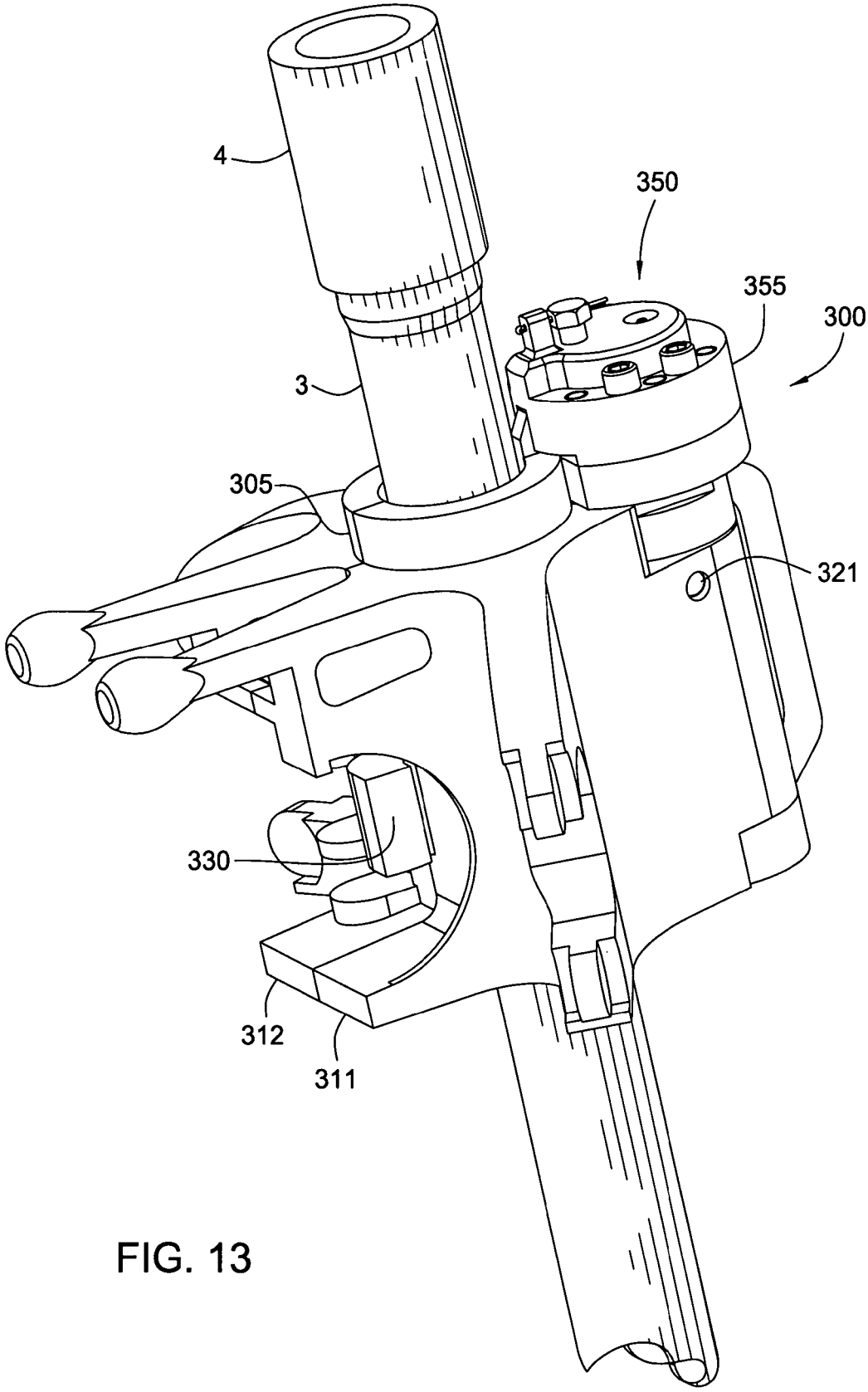
FIG. 13 shows another embodiment of an elevator having a safety lock assembly.
Figure 14:
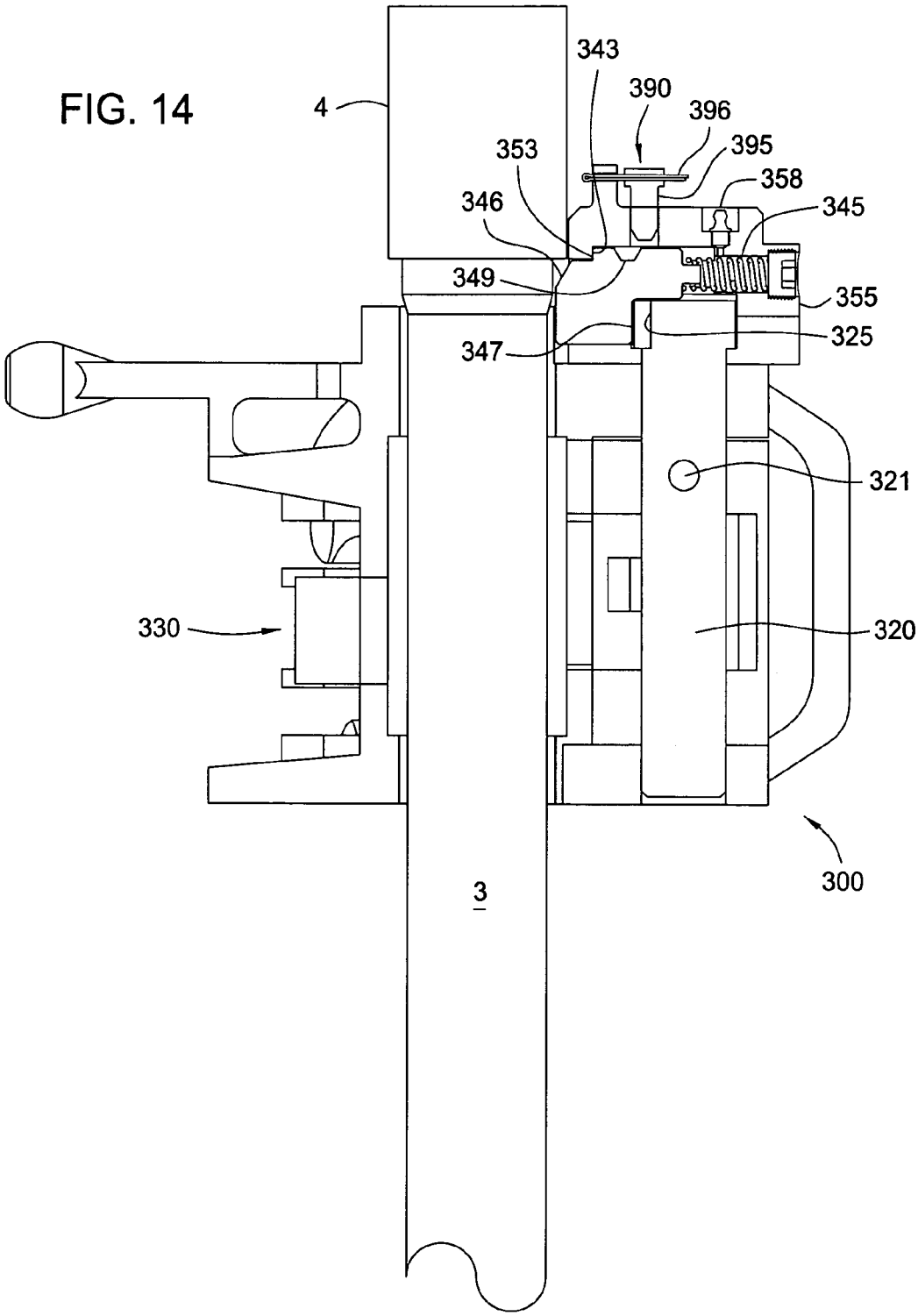
FIG. 14 is a cross-sectional view of the elevator of FIG. 13 with safety lock assembly in the unactivated position.

FIGS. 13 and 14 show the safety lock assembly 350 in the unactivated position. Referring now to the cross-sectional view of FIG. 14, an actuating member is movably disposed in the housing 355. As shown, the actuating member comprises a locking blade 340, which is biased in the unactivated or extended position by a biasing member 345. In one aspect, the locking blade 340 is biased such that a predetermined portion of the locking blade 340 extends out of the housing 355 in the direction of the tubular 3. Preferably, the locking blade 340 extends out to the edge of the bore 310 so that it may come into contact with the coupling 4 of the tubular 3. The collar 305 may include a passage to accommodate the movement of the locking blade 340. In one embodiment, the locking blade 340 includes a flange 343 that is mateable with a stop flange 353 formed in the housing 355. The flanges 343, 353 are adapted to limit the extension of the locking blade 340 in the unactivated position. In another embodiment, a fitting 358 may be provided to supply lubricants to facilitate movement of the locking blade 340.

The safety lock assembly 350 may be activated by the coupling 4 of the tubular 3. In one embodiment, the upper portion of the locking blade 340 extending out of the housing 355 may include a beveled or camming surface 346. In this respect, as the coupling 4 is lowered toward the collar 305, the beveled surface 346 allows the coupling 4 to gradually overcome the biasing member 345, thereby translating the locking blade 340 from the unlocked position to the locked position. FIG. 14 shows the safety lock assembly 350 in the activated or locked position.

Figure 15:
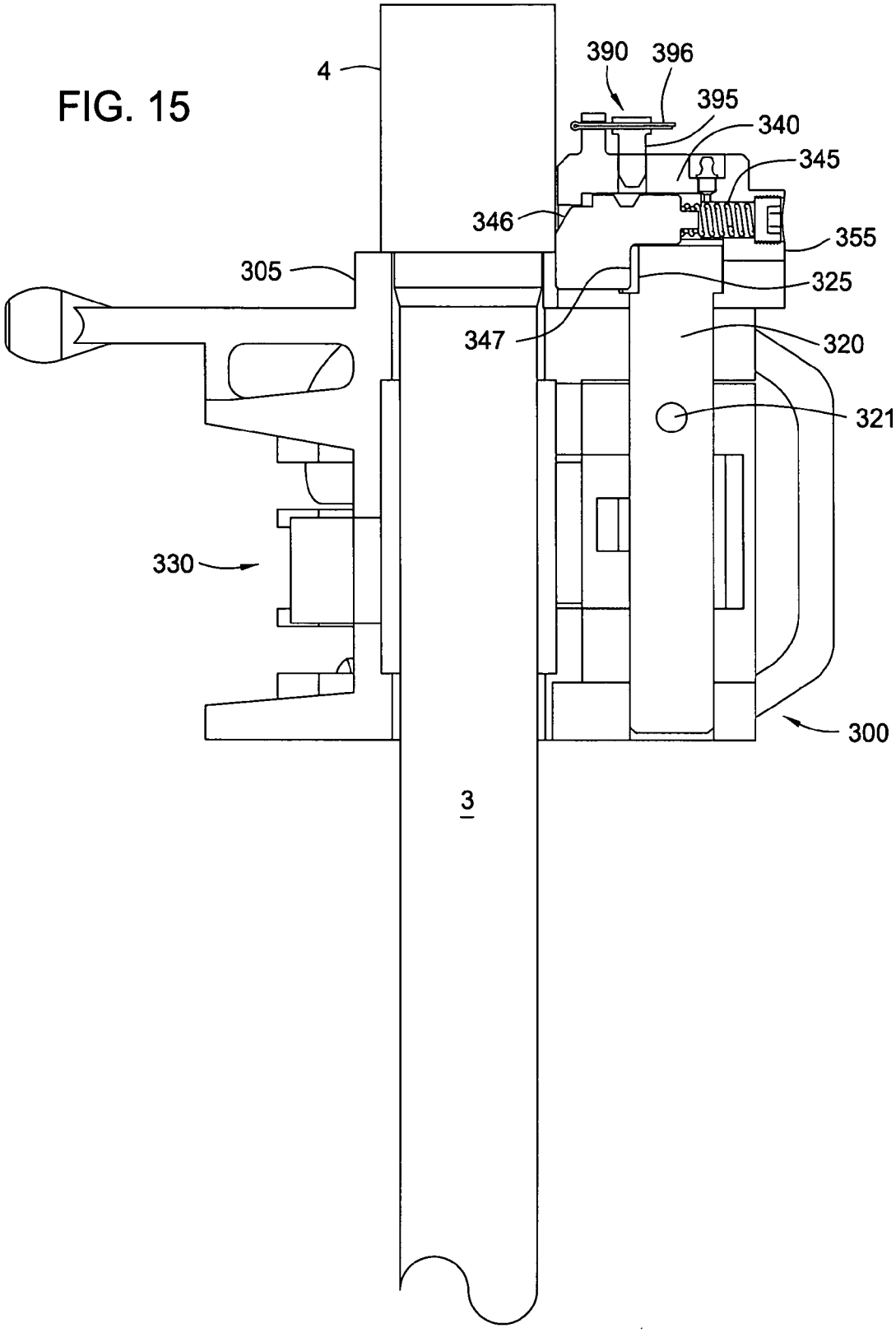
FIG. 15 is a cross-sectional view of the elevator of FIG. 13 with safety lock assembly in the activated position.

To lock the elevator 300 in the closed position, the locking blade 340 is adapted to engage a locking member formed in the hinge shaft 320 when the locking blade 340 is in the activated position. In one embodiment, the locking member comprises a locking slot 325 that is mateable with a lower flange 347 of the locking blade 340. As shown in FIG. 14, the lower flange 347 is positioned so that it does not engage the locking slot 325 of the hinge shaft 320 when the locking blade 340 is unactivated. In this respect, the body sections 311, 312 of the elevator 300 are allowed to swing open or close. When the locking blade 340 is translated, the lower flange 347 slides toward the slot 325 and engages the slot 325. In this position, the locking blade 340 prevents the hinge shaft 320 from rotating. Because the first and second body sections 311, 312 are coupled to the hinge shaft 320 and the housing 355, respectively, the first and second body sections 311, 312 are prevented from relative rotational movement, as shown in FIG. 15. As a result, the elevator 300 cannot be opened when the locking blade 340 is activated.

In another aspect, the safety lock assembly 350 is provided with a secondary locking apparatus 390. In one embodiment, the secondary locking apparatus 390 comprises a retaining member 395 mateable with the locking blade 340 when the locking blade 340 is in the locked position. As shown in FIG. 14, the retaining member 395 comprises a screw disposed on the upper portion of the housing 355. The retaining member 395 may be inserted into a receiving member 349 formed in the locking blade 340. The retaining member 395 may be selectively held by a securing pin 396 until it is ready to be activated. After the locking blade 340 is translated, the receiving member 349 is aligned with the retaining member 395. Thereafter, the retaining member 395 is released from the securing pin 396 and is at least partially inserted into the locking blade 340, thereby holding the locking blade 340 in the locked position.

In operation, the elevator 300 is closed around the tubular 3 at a location below the coupling 4. As seen in FIG. 14, the locking blade 340 is biased in the extended or unactivated position. As the elevator 300 is lifted by the hoisting structure, the collar 305 of the elevator 300 will slide along the tubular 3 toward the coupling 4.

When the coupling 4 contacts the beveled surface 346 of the locking blade 340, the coupling 4 will cause the locking blade 340 to translate, thereby camming the lower flange 347 into the slot 325 of the hinge shaft 320 for safety lock activation. As seen in FIG. 15, the coupling 4 rests on top of the collar 305, and the locking blade 340 is cammed between the slot 325 of the hinge shaft 320 and the coupling 4. In this respect, the first and second body sections 311, 312 are prevented from relative rotational movement. In this manner, the elevator 300 is prevented from opening when a tubular 3 is retained therein.

Figure 16:
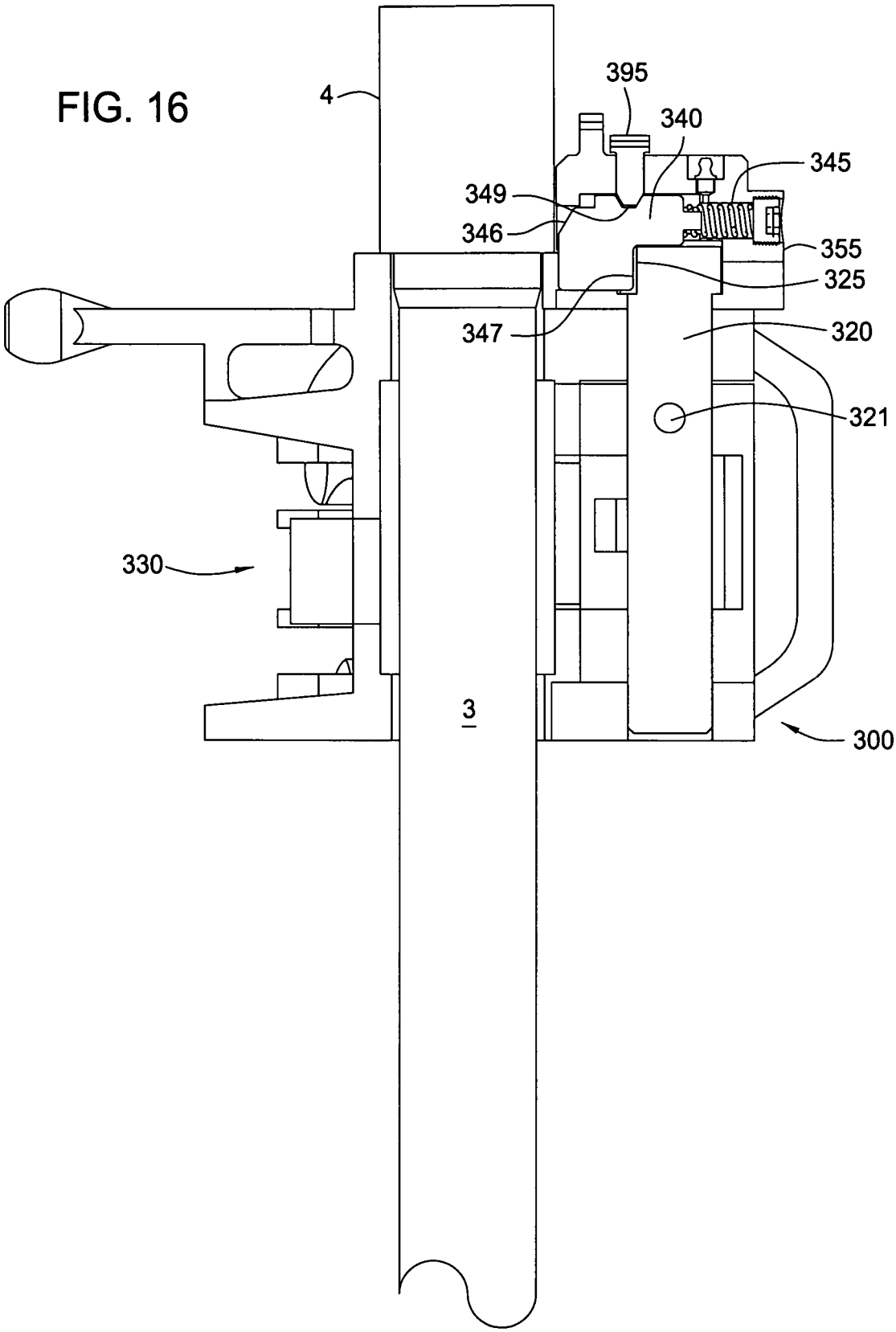
FIG. 16 is a cross-sectional view of the elevator of FIG. 13 with secondary lock apparatus in the activated position.

When a jarring operation is necessary, the retaining member 395 is inserted into the locking blade 340, as illustrated in FIG. 16. When the locking blade 340 is in the activated position, the receiving member 349 is aligned with the retaining member 395. After the retaining member 395 is at least partially inserted, the retaining member 395 will hold the locking blade 340 in the activated position even if the locking blade 340 is no longer cammed by the coupling 4. As a result, the safety lock assembly 350 will remain activated even if the coupling 4 is displaced from the collar 305 during jarring operations.

In another embodiment, an elevator for handling a tubular includes a first body member coupled to a second body member, an actuating member operatively coupled to the elevator for engaging the tubular, and a locking member adapted to engage the actuating member, wherein engagement with the actuating member secures the first body member and the second body member against opening.

In yet another embodiment, the elevator may include a hinge member for pivotally coupling the first body member to the second body member. In yet another embodiment, the actuating member is coupled to the hinge member of the elevator. In yet another embodiment, the locking member is formed on the hinge member.

In yet another embodiment, the elevator further comprises a biasing member for biasing the actuating member. Preferably, the hinge member is adapted to allow the biasing member to bias the actuating member between an activated position and an unactivated position. The actuating member engages the locking member when the actuating member is in the activated position.

In yet another embodiment, the elevator includes a biasing member for biasing the actuating member. In yet another embodiment, the actuating member is adapted to engage an upset portion of the tubular. Preferably, the upset portion of the tubular comprises a coupling. In yet another embodiment, engagement with the upset portion causes the actuating member to engage the locking member.

While the foregoing is directed to embodiments of the present invention, other and further embodiments of the invention may be devised without departing from the basic scope thereof, and the scope thereof is determined by the claims that follow.

We claim:

1. A tubular handling apparatus for supporting a tubular, comprising:

a body for supporting the tubular;

a locking apparatus activatable by an upset portion of the tubular, the locking apparatus having an actuating member for contacting the upset portion for activation and wherein the actuating member engages a locking member to prevent the tubular handling apparatus from releasing the tubular when activated; and a latch member for maintaining the actuating member in engagement with the locking member.

2. The apparatus of claim 1, wherein contact with the upset portion activates the locking apparatus.

3. The apparatus of claim 1, wherein the body comprises:

a first body section operatively coupled to a second body section; and a bore for receiving the tubular, the bore formed by bringing the body sections together.

4. The apparatus of claim 1, wherein the body comprises:

a first body section operatively coupled to a second body section; and a hinge member for coupling the body sections.

5. The apparatus of claim 4, wherein the actuating member engages the hinge member when activated by the tubular.

6. The apparatus of claim 4, wherein the body further comprises a lock latch for locking the body sections together.

7. The apparatus of claim 1, wherein the locking apparatus comprises an opening for supporting the tubular.

8. The apparatus of claim 7, wherein an inner diameter of the opening is smaller than an outer diameter of the upset portion.

9. The apparatus of claim 1, wherein the upset portion comprises a coupling.

10. The apparatus of claim 1, wherein the tubular comprises a tubing.

11. The apparatus of claim 1, wherein a substantial portion of the load from the tubular is transferred to the locking member.

12. The elevator of claim 1, further comprising a biasing member for biasing the actuating member.

13. The elevator of claim 1, wherein the latch member comprises a sliding latch.

14. The elevator of claim 1, further comprising a guide member for aligning the actuating member to the body.

15. The elevator of claim 1, wherein the actuating member comprises a horseshoe shape.

16. A method for supporting a tubular, comprising:

providing a tubular handling apparatus, having:

a body for receiving the tubular;

a locking apparatus activatable by the tubular; and a latch member;

inserting the tubular through the body;

engaging an upset portion of the tubular with the locking apparatus, thereby activating the locking apparatus to prevent the body from releasing the tubular; and engaging the latch member to the locking apparatus to maintain the locking apparatus in the activated position.

17. The method of claim 16, further comprising supporting the tubular with the locking apparatus.

18. An elevator for handling a tubular, comprising:

a first body member coupled to a second body member;

an actuating member operatively coupled to the elevator for engaging the tubular;

a locking member disposed on an upper portion of the elevator and adapted to engage the actuating member, wherein engagement with the actuating member secures the first body member and the second body member against opening; and a hinge member for pivotally coupling the first body member to the second body member, wherein the actuating member is coupled to the hinge member of the elevator.

19. The elevator of claim 18, wherein the locking member is formed on the hinge member.

20. The elevator of claim 19, wherein the actuating member moves radially to engage the locking member.

21. The elevator of claim 20, wherein the engagement with the tubular causes radial movement of the actuating member.

22. The elevator of claim 20, further comprising a biasing member adapted to bias the actuating member in the radial direction.

23. The elevator of claim 18, further comprising a biasing member for biasing the actuating member.

24. The elevator of claim 23, wherein the hinge member is adapted to allow the biasing member to bias the actuating member between an activated position and an unactivated position.

25. The elevator of claim 24, wherein the actuating member engages the locking member when the actuating member is in the activated position.

26. The elevator of claim 18, wherein the actuating member is adapted to engage an upset portion of the tubular.

27. The elevator of claim 26, wherein the upset portion of the tubular comprises a coupling.

28. The elevator of claim 26, wherein the engagement with the upset portion causes the actuating member to engage the locking member.

29. The elevator of claim 18, wherein the elevator includes at least two locking members and at least one lock member is disposed on the upper portion of each of the first body member and the second body member.

30. The elevator of claim 18, wherein the actuating member includes a first arm for engaging a first locking member on the first body member and a second arm for engaging a second locking member on the second body member.

31. The elevator of claim 18, wherein the actuating member includes an opening for engaging the hinge member.

* * * * *